US006240754B1

(12) United States Patent
Petersen

(10) Patent No.: US 6,240,754 B1
(45) Date of Patent: Jun. 5, 2001

(54) VEHICLE SECURITY DEVICE

(76) Inventor: Steven D. Petersen, 1527 W. Boise Pl., Chandler, AZ (US) 85224

( * ) Notice: Subject to any disclaimer, the term of this patent is extended or adjusted under 35 U.S.C. 154(b) by 0 days.

(21) Appl. No.: 09/344,153

(22) Filed: Jun. 24, 1999

(51) Int. Cl.[7] ..... E05B 15/16

(52) U.S. Cl. ..... 70/417; 292/346; 292/DIG. 23; 70/416; 70/448

(58) Field of Search ..... 70/416–418, 208, 70/448, 451; 292/346, 336.3, DIG. 23, DIG. 31, DIG. 67

(56) References Cited

U.S. PATENT DOCUMENTS

| | | | | |
|---|---|---|---|---|
| 4,041,741 | | 8/1977 | Citron . | |
| 4,113,294 | * | 9/1978 | Bierman | 292/346 |
| 4,212,176 | * | 7/1980 | Hegedus | 70/417 |
| 4,508,379 | * | 4/1985 | Mochida | 292/336.3 |
| 4,541,260 | | 9/1985 | Rubenstein . | |
| 4,619,123 | * | 10/1986 | Hill | 70/417 |
| 4,628,300 | | 12/1986 | Amato . | |
| 4,700,556 | | 10/1987 | Wade, Sr. . | |
| 4,850,209 | * | 7/1989 | Weinerman et al. | 70/208 |
| 4,852,373 | * | 8/1989 | McGough | 70/417 |
| 5,176,016 | * | 1/1993 | Hill | 70/417 |
| 5,303,971 | * | 4/1994 | Johnson et al. | 70/208 X |
| 5,435,609 | * | 7/1995 | Igata et al. | 292/346 |
| 5,477,712 | * | 12/1995 | Hill | 70/418 X |
| 5,499,851 | * | 3/1996 | Mitchell | 292/DIG. 31 X |
| 5,586,458 | * | 12/1996 | Weinerman et al. | 70/208 |
| 5,676,002 | | 10/1997 | Hoeptner, III . | |
| 5,709,420 | * | 1/1998 | Umino | 292/346 X |
| 5,806,352 | * | 9/1998 | Axford | 70/416 X |
| 5,987,943 | * | 11/1999 | Verga et al. | 292/DIG. 31 X |
| 5,988,712 | * | 11/1999 | Segelin | 70/418 X |
| 6,014,876 | * | 1/2000 | Taylor | 70/417 X |

* cited by examiner

*Primary Examiner*—Suzanne Dino Barrett

(57) ABSTRACT

This vehicle security device (40) is a metal plate (38) bolted to a door handle unit inside a vehicle door to prevent unauthorized unlocking of a vehicle door by jamming a thin tool into a vehicle door. And, device (40) prevents unauthorized unlocking of a vehicle door by inserting a thin tool between the seam between the window glass and the flexible molding around a door window frame of a vehicle door. When installed, the device (40) blocks access to the inner end of a lock cylinder (10) by preventing the insertion of thin tools directly to the inner end of the lock cylinder (10). This device (40) is comprised of a configured metal plate (38), angled on its upper end to extend horizontally toward the inside of a vehicle door; one or more bolts (43); one or more spacers (42); and one or more lock washers (41). The metal plate (38) has a rectangular-shaped cut out (45) to accommodate placement adjacent to the key-turnable inner end of a door lock cylinder (10). Metal plate (38) is secured in place by one or more bolts (43) which extend through preformed holes (46) in plate (38).

16 Claims, 6 Drawing Sheets

VEHICLE SECURITY DEVICE

BACKGROUND OF THE INVENTION

This invention relates to vehicle security devices, specifically to such devices which are used to prevent unauthorized entry into locked doors of vehicles by insertion of certain tools and implements, other than a door key, into a door or between a door and a vehicle window.

A key-operated lock of a vehicle door includes a lock cylinder which extends into a door handle unit. The lock cylinder has an inner end and linkage which connects the inner end of the lock cylinder to a door lock. Typically, the lock cylinder is located below the door window. Access to the inner end of the lock cylinder allows manipulation by those who would steal or forcibly enter a vehicle.

Forced entry to a vehicle can be accomplished by downward insertion of a thin tool, between a vehicle door window glass and flexible molding around a door window frame. Such a tool pushes aside the molding which allows the tool into the cavity of a door through an opening created by the tool.

Another method of entry to a vehicle is accomplished by downward insertion of an implement, such as a stiff wire which is hooked or notched at one end, between a vehicle door window glass and the flexible molding around a door window frame. A linkage rod at the inner end of the lock cylinder inside the vehicle door can be manipulated with the aforementioned thin tool or stiff wire. This manipulation unlocks the door.

The lock cylinder of a vehicle door is often a component of a door handle unit that seats at a conforming opening in the outer shell of a door. Another common technique for unlocking a door is to insert a screw driver, or similar tool, between the conforming opening at the edge of a door handle unit and the vehicle door. After bending the vehicle door and its door handle unit and inserting such a tool, the tool is used to manipulate a linkage rod connected to the inner end of the lock cylinder. Prior art does not provide easily installed and inexpensive means for preventing unlocking a vehicle door using such techniques. Without altering the appearance of a vehicle, this invention shields, blocks, and prohibits forced entry into a vehicle by insertion of tools through flexible molding around a window or the seam between the door handle unit and the door of such a vehicle.

DESCRIPTION OF THE PRIOR ART

Inventors have created devices for inhibiting the form of lock manipulation described above. U.S. Pat. No. 4,041,741 to Cintron (1977), discloses an automobile trunk guard which consists of two protective plates. One plate is mounted on the outside and the other plate is mounted on the inside of a trunk lid. Installation of these plates requires drilling holes into the exterior of a trunk. The result is not aesthetically pleasing.

U.S. Pat. No. 4,541,260 to Rubinstein and Rubinshtein (1985) discloses a guard plate which protects the cylinder of a lock. This guard plate consists of fingers and discs which rotate and studs which contain electrical contacts for completion of an electrical alarm circuit. This guard plate is expensive to produce and difficult to install.

U.S. Pat. No. 4,628,300 to Amato (1986) discloses a cover strip attached to the sash of a vehicle window to prevent release of lock actuating levers by inserting rods or other instruments. This cover strip will not inhibit entry to a vehicle through a door handle unit, and, it is not aesthetically pleasing.

U.S. Pat. No. 4,700,556 to Wade, Sr. and Spector (1987) discloses a protective visor for vehicle door handles consisting of a hood to protect a door handle from inclement weather. This visor in its preferred embodiment does not inhibit unauthorized entry to a vehicle.

U.S. Pat. No. 5,676,002 to Hoeptner, III (1997) discloses a guard housing which encloses the vulnerable portion of a linkage inside a vehicle door. The housing includes an extension angled along the inside of a door between the outer shell and the side impact beam of the door. The extension has no apparent deterring affect from unauthorized entry to a vehicle. This guard housing is difficult to install as the side impact spacer may have to be removed in order to install the housing. Also, this guard housing is expensive to produce.

DISADVANTAGES OF PRIOR ART

Heretofore known devices for vehicle door security suffer from a number of disadvantages. The following descries the disadvantages of previously disclosed devices and provides reasons the present invention is superior.

(a) Existing devices for vehicle security are difficult to install, as some devices require drilling and metal cutting, some require removal or replacement of existing door handle assemblies, and some require removal of the adhesive spacer between a door and its side impact beam. Due to the simplicity of the design and method of installation of the present invention, installation is easier, resulting in a less costly installation.

(b) Existing devices for vehicle security are more difficult and more expensive to manufacture because multiple parts and more than one bend, or angle are required; consequently, more time and materials are required to produce them. Due to the simplicity of the design of the present invention, and use of standard production parts, a minimal amount of material and production time is required. The result is lower production costs.

(c) Some existing devices for vehicle security have moving parts which require maintenance. The present invention does not require moving parts; therefore, it does not require maintenance.

(d) Some existing devices for vehicle security require power from batteries in order for protection to remain uninterrupted. The result is a need for periodic maintenance and a danger of interrupted protection. This is not an issue with the present invention.

(e) Some existing devices for vehicle security require activation, which if not done would eliminate protection. This is not an issue with the present invention.

(f) Some existing devices for vehicle security are installed on the exterior of a vehicle. The present invention does not require unsightly plates on the outside of a vehicle.

(g) Some existing devices for vehicle security have complex designs which make the devices difficult for an owner of a vehicle to understand. The result of this lack of understanding is that the owner may not see the benefits of such devices. This is not an issue with the present invention due to its simplicity of design, use of standard production parts, and ease of installation.

(h) Some existing devices for vehicle security require alteration of vehicle components. This is not an issue with the present invention.

OBJECTS AND ADVANTAGES

Accordingly, besides the objects and advantages of the vehicle security device previously described, several objects and advantages of the present invention are:

(a) to provide a vehicle security device which is easier to install because no drilling, metal cutting, removal or replacement of existing door handle assemblies, or removal of side impact beam door adhesive spacer is required, resulting in a less costly installation;

(b) to provide a vehicle security device which is less difficult and less expensive to manufacture, as fewer parts are required due to the simplicity of design, and because standard production parts are used, less material and manufacturing time is required, resulting in lower cost to the consumer;

(c) to provide a vehicle security device which requires no moving parts, resulting in little or no maintenance;

(d) to provide a vehicle security device which does not require power from batteries, resulting in no maintenance and no danger of interrupted protection;

(e) to provide a vehicle security device which requires no action to activate or engage, ensuring protection without interruption;

(f) to provide a vehicle security device which is installed inside a vehicle door, eliminating the need for unsightly plates on the outside of a vehicle;

(g) to provide a vehicle security device which is more easily understood by the owner of a vehicle, benefiting the seller and the user of the device; and, (h) to provide a vehicle security device which does not require alteration of vehicle components, resulting in less costly installation.

It is a principal object of the vehicle security device to provide: (1) a simple to manufacture, (2) easy to install, (3) low maintenance, and (4) easy to understand, means for preventing unauthorized unlocking of a vehicle door by the methods herein described.

Further objects and advantages of this invention will become apparent from a consideration of the drawings and ensuing description of the vehicle security device.

BRIEF SUMMARY OF THE INVENTION

This vehicle security device in its preferred embodiment consists of a configured metal plate, one or more bolts, two or more spacers, and one or more lock washers. The plate has: (i) a rectangular-shaped cut out, (ii) a rectangular-shaped extension below the cut out, (iii) an angle on its upper end which extends horizontally toward the inside of a vehicle door, and (iv) several holes.

One aspect of the device is to shield, block, and prohibit unlocking a vehicle door by inserting an implement, other than a door key, into or around a door handle unit.

Another aspect of the device is to shield, block, and prohibit unlocking a vehicle door by inserting a thin tool between the space between the window glass and the flexible molding around a door window frame.

Doors of the type to which the vehicle security device is applicable have a door lock with a latching member which is shifted to lock a door. A lock cylinder is located within the door handle unit. This lock cylinder is the activating source for shifting the latching member. The lock cylinder has an outer end that is accessible from outside the vehicle, and has a key-turnable inner end situated inside the door. The inner end of the lock cylinder is connected to an actuator and the door lock by a linkage rod. The linkage rod allows locking and unlocking the door, because the door key turns the actuator on the inner end of the lock cylinder. The vehicle security device has been proportioned for placement within a door at the location of the door handle unit between the door and the inner end of the lock cylinder. The device has a rectangular-shaped cut-out which enables placement of the device between the door handle unit and the actuator. That is, the device is installed between the access points for unlawful entry and the inner end of the lock cylinder and the linkage connected to the actuator.

In its preferred embodiment, the vehicle security device has a configured metal plate with a rectangular-shaped cut out which creates a rectangular-shaped extension at the bottom of the cut out. This extension shields, blocks, and prohibits insertion of a thin tool, such as a screw driver, into or around a door handle unit. And, the extension prevents the plate from being moved up or down. Therefore, a tool cannot make direct contact with the linkage between the actuator and door lock mechanism The result is that the actuator and linkage cannot be accessed and manipulated to allow the door to be unlocked.

In its preferred embodiment, the vehicle security device has a configured metal plate with an angle on its upper end which extends horizontally toward the inside of a vehicle door. Several holes in the plate permit attachment to a door handle unit and openings for casting flash or other protrusions. The angle shields, blocks, and prohibits access to the actuator and linkage rod by a thin tool between the space between the window glass and the flexible molding around a door window frame.

OTHER ASPECTS OF THE INVENTION

In another aspect of the invention, the vehicle security device shields a second linkage rod attached to the actuator of a lock cylinder in certain vehicles. This additional linkage allows the use of an electronic door-opening device. The present invention prevents access, by use of thin tools through the opening between a window glass and an outer shell of such a vehicle, to this second linkage. The present invention also prevents access by use of implements through the seam between a door handle unit and the outer shell of such vehicle doors.

In another aspect of the invention, the vehicle security device is installed on a rear door handle unit of certain vehicles such as, but not limited to, sport utility vehicles and vans. Such rear doors have a key-operated lock cylinder similar to a key-operated lock cylinder in a passenger door of a vehicle.

In another embodiment, the configured plate of the vehicle security device has an angle on the entire length of its lower end which extends horizontally toward the outside of a vehicle door. This angle allows the plate to be smaller, while still preventing access with a screw driver or other thin tool. If a thin tool is jammed into the seam between the door handle unit and the vehicle door, this angled extension shields, blocks, and prohibits access to the actuator and linkage.

In all its embodiments, the vehicle security device shields an actuator located on the inner end of a key-operated lock cylinder, and shields the upper end of a linkage rod. The linkage rod connects the actuator and door lock mechanic Consequently, these otherwise vulnerable components of a lock system cannot be manipulated with a thin tool inserted between the flexible molding and window glass at the base of a door window. And, the lock system components cannot be manipulated by jamming a thin tool between a door handle unit and a vehicle door.

The vehicle security device can be retrofitted easily into pre-existing vehicle doors. The device can be secured onto an existing door handle unit using a replacement bolt, one or more lock washers, and one or more spacers.

BRIEF SUMMARY OF THE PREFERRED EMBODIMENT

The present invention describes a device made of metal and configured into a metal plate angled on its upper end and secured into place by one or more bolts which extend through preformed holes in the plate. The plate has a rectangular-shaped cut out to accommodate placement adjacent to the inner end of a vehicle door lock cylinder. The plate is disposed within a vehicle door at the location of a key-turnable inner end of a lock cylinder of a vehicle door. An existing door handle unit does not need to be removed to install the plate, as the plate is secured into place by a replacement bolt extended to accommodate the plate, a lock washer and one or more spacers.

This vehicle security device shields, blocks, and prohibits forced entry through use of a thin tool or similar homemade implement. The plate blocks the unlocking of a vehicle door by means other than a key. And, the plate blocks the unauthorized unlocking of a vehicle door which has a properly installed electronic door-opening mechanism.

BRIEF SUMMARY OF VARIATIONS OF THE INVENTION

While the above summaries describe many specificities of the preferred embodiment, these should not be construed as limitations on the scope of the invention, but rather as an exemplification of one preferred embodiment thereof. Examples of variations are plates of different materials and varying dimensions, thickness, and hole locations. Angled extension dimensions and location of extension can vary. Also, sizes and shapes of the cut-out section of the plate can be varied. Variations accommodate differences in door lock mechanisms.

The vehicle security device, together with further aspects and advantages thereof, may be further understood by reference to the following detailed description of the preferred embodiment and reference to the accompanying drawings.

Figure 1:
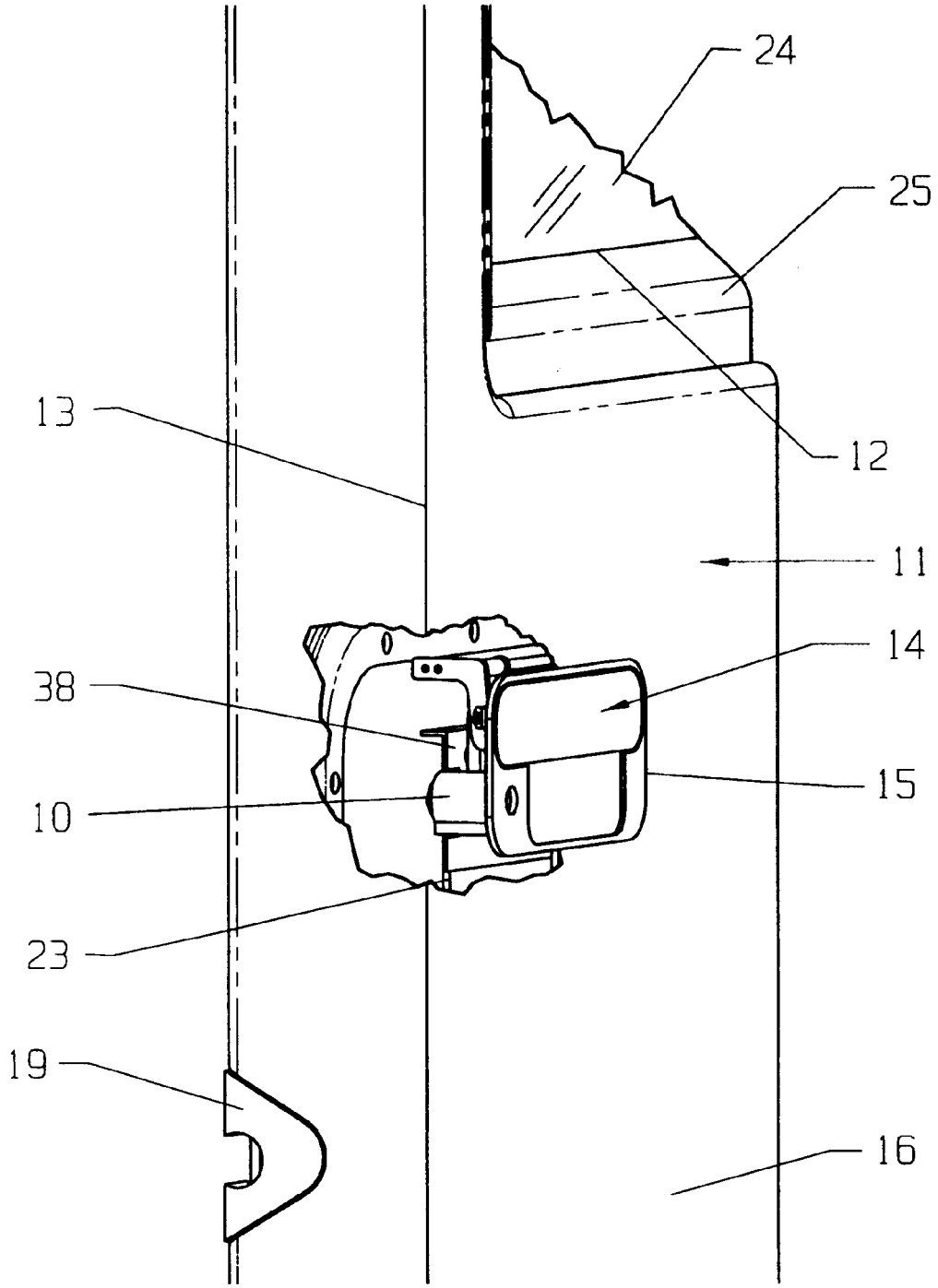
FIG. 1 is an outside view of a vehicle door with a section of a door handle unit broken out to show a lock cylinder and placement of the plate.

| Reference Numerals in Drawings |
|---|
| 10 lock cylinder |
| 11 vehicle door |
| 12 base of window |
| 13 back edge of door |
| 14 door handle unit |
| 15 conforming opening in outer shell |
| 16 outer shell |
| 17 actuator |
| 18 linkage rod |
| 19 door latch |
| 20 latching member |
| 21 casting flash |
| 22 lower end of linkage rod |
| 23 upper end of linkage rod |
| 24 window glass |
| 25 flexible molding |
| 26 interior door trim |
| 30 bracket |
| 31 side impact beam |
| 32 factory-installed bolts |
| 38 plate |
| 40 vehicle security device |
| 41 lock washer |
| 42 spacers |
| 43 replacement bolt |
| 44 angled horizontal extension |
| 45 rectangular-shaped cut out |
| 46 mounting hole |
| 47 holes for casting flash |
| 48 alternative mounting hole |
| 49 rectangular-shaped extension |

DETAILED DESCRIPTION OF THE INVENTION

It is an object of the vehicle security device to provide one or more of the following desirable features not heretofore known or used.

Description—FIG. 1

FIG. 1 is an outside view of a vehicle door 11 with a section of a door handle unit 14 broken out to show a lock cylinder 10 and placement of plate 38.

Referring to FIG. 1 of the drawings, key-operated lock cylinder 10 of vehicle door 11 is located below the base of window 12 of door 11 and at a location close to back edge 13 of door 11. Lock cylinder 10 is a component of door handle unit 14 which seats at conforming opening 15 in outer shell 16 of door 11. Upper end of linkage rod 23 connects lock cylinder 10 to door latch 19. Flexible molding 25 seals space between base of window 12 and window glass 24. Plate 38 is shown installed on back of door handle unit 14.

Lock cylinder 10, door handle unit 14, and door latch 19 are of known conventional construction; thus, will not be further described.

Figure 2:
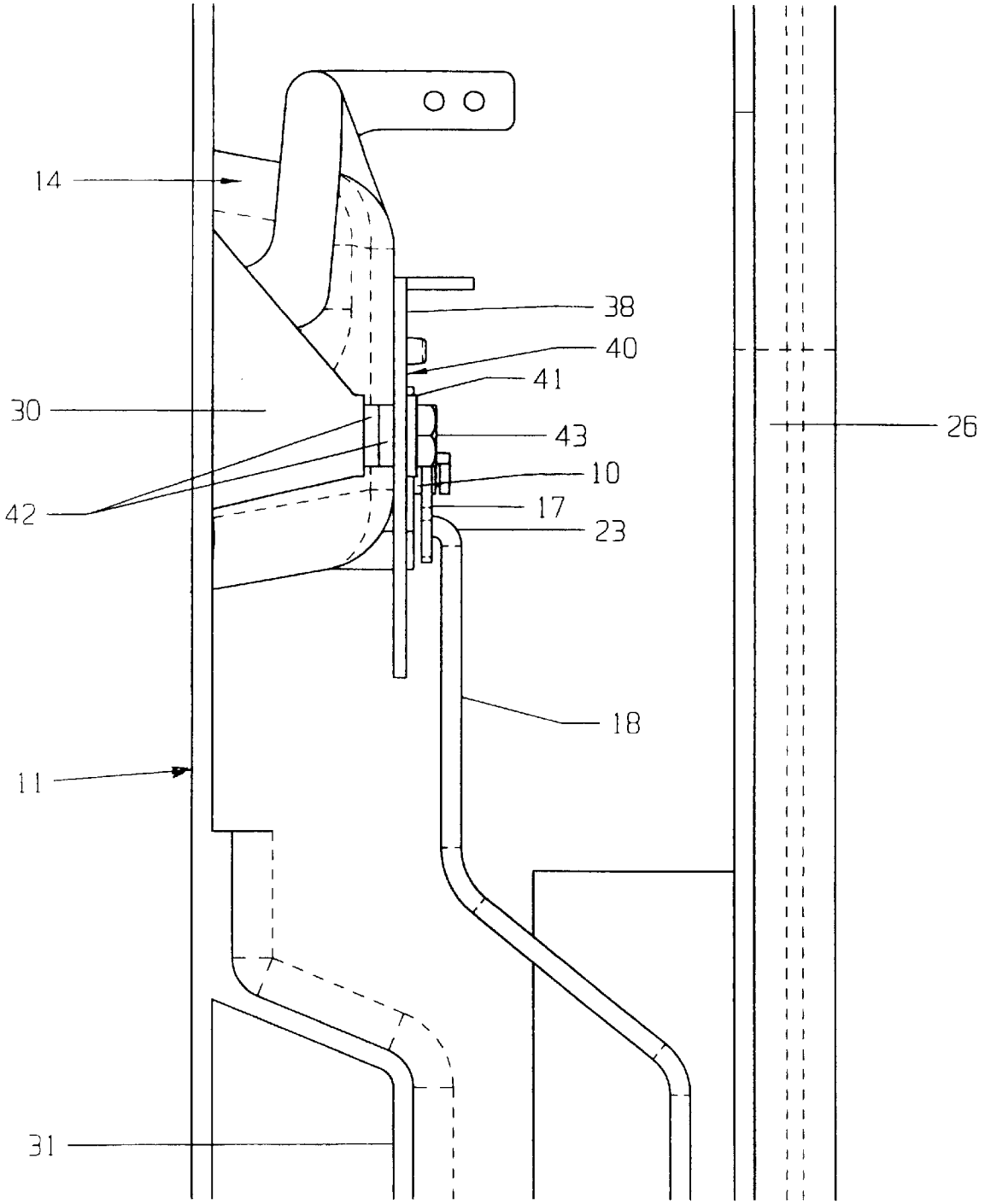
FIG. 2 is an end view of the section of a vehicle door where a door handle unit is positioned, showing a side view of the installed vehicle security device.

Description—FIG. 2

FIG. 2 is an end view of the section of vehicle door 11 where door handle unit 14 is positioned, showing a side view of vehicle security device 40, after installation. FIG. 2 shows upper end 23 of linkage rod 18 connected to actuator 17 at lock cylinder 10, the portion of a door lock system which is protected by vehicle security device 40. Security device 40 is installed after removing interior door trim 26. To install security device 40, lock washer 41 is placed on replacement bolt 43. Bolt 43 is inserted through plate 38. Spacers 42 are placed on bolt 43 between bracket 30 and plate 38. Bolt 43 is securely tightened. Plate 38 is then properly aligned between actuator 17 and lock cylinder 10. No changes are required to side impact beam 31 due to presence of installed vehicle security device 40.

Figure 3:
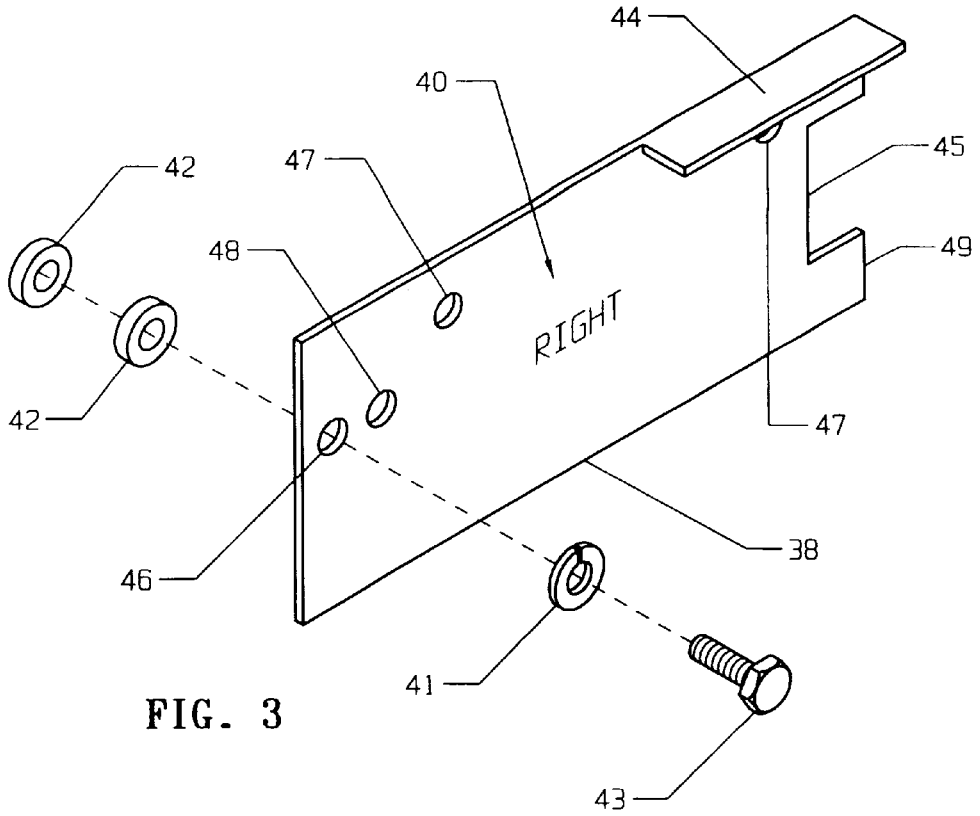
FIG. 3 is an exploded view of the components of the vehicle security device.

Description—FIG. 3

FIG. 3 is an exploded view of the components of vehicle security device 40, comprised of plate 38, lock washer 41, spacers 42, and replacement bolt 43. Lock washer 41, spacers 42, and bolt 43 are of standard production origin. Vehicle security device 40 is manufactured by preparing a die to form plate 38. Plate 38 is stamped out from cold rolled steel. Stamping process creates rectangular-shaped cut out 45, mounting hole 46, alternative mounting hole 48, and holes for casting flash 47. Cut out 45 creates rectangular-shaped extension 49. After stamping process, plate 38 is bent to form either right plate or left plate, the right for a passenger-side door and the left for a driver-side door. The bending forms angled horizontal extension 44 shown in FIG. 3.

Plate 38 formed for a passenger-side door is stamped with either the initial R or the word Right, and for a driver-side door is stamped with either the initial L or the word Left.

Zinc-plating, or an equivalent coating, is used on plate 38 to inhibit corrosion.

Figure 4A:
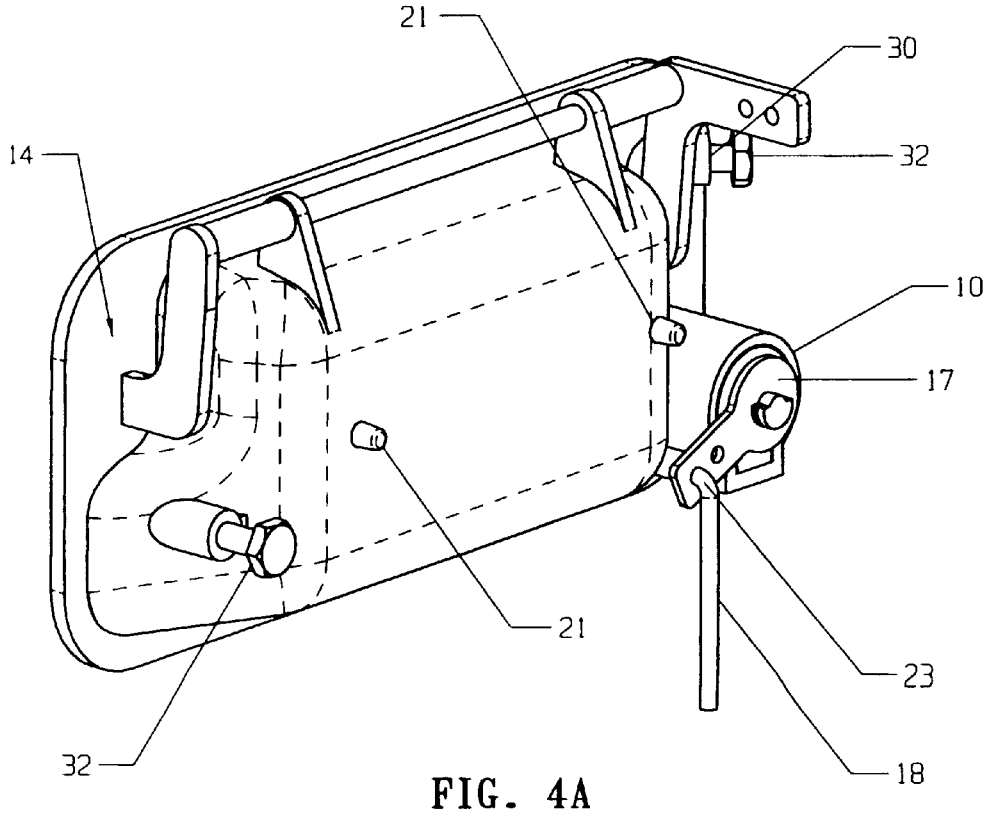
FIG. 4A is an isometric view of a door handle unit and lock cylinder, prior to installation of the vehicle security device, showing factory-installed bolt.

Description—FIG. 4A

FIG. 4A is an isometric view of door handle unit 14, and lock cylinder 10, prior to installation of invention, showing factory-installed bolts 32 in place which secure door handle unit 14. Actuator 17, upper end 23 of linkage rod 18, and bracket 30 are also shown. Factory-installed bolt 32, farthest from lock cylinder 10, will be replaced when invention is installed. Casting flash 21 is present on some door handle units 14.

Figure 4B:
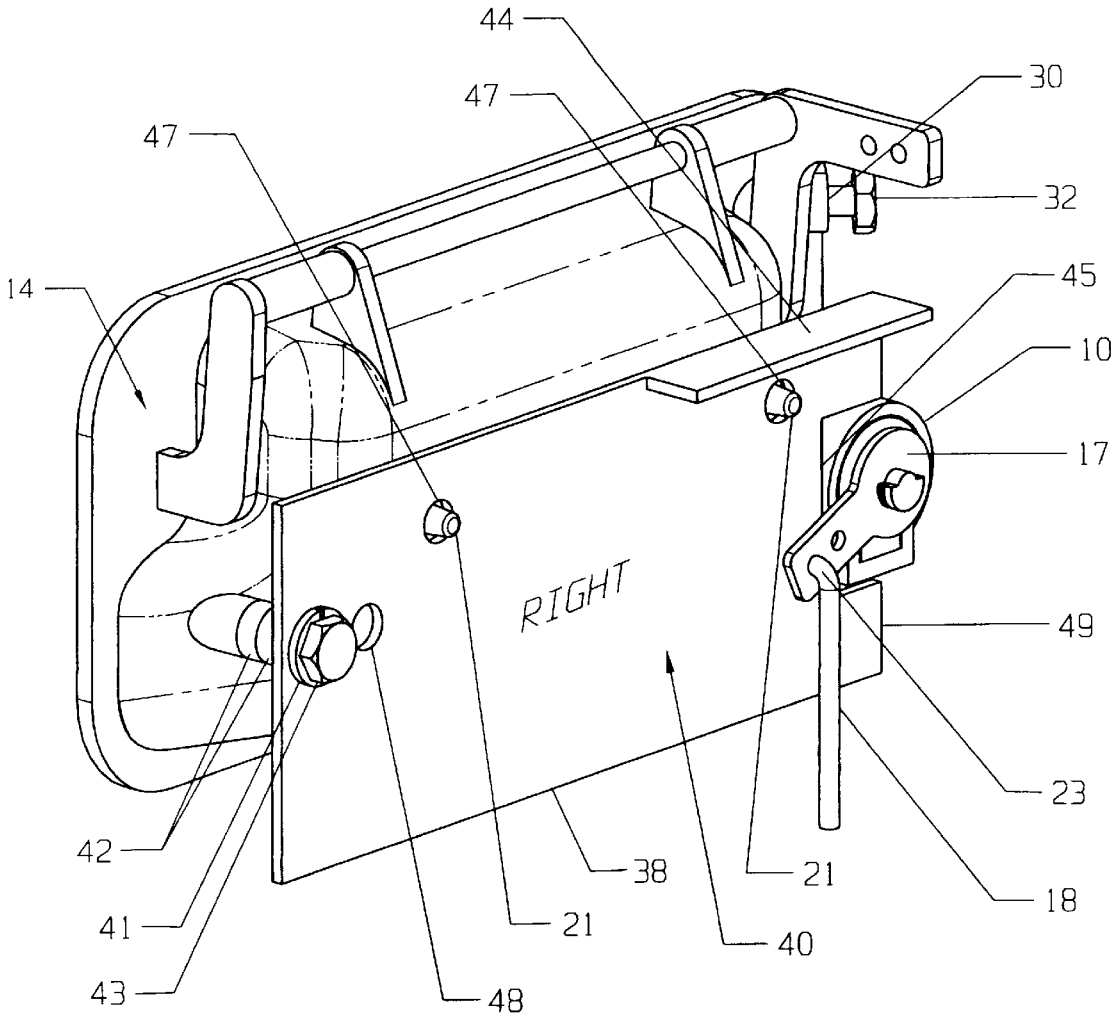
FIG. 4B is a back view of the vehicle security device, after installation on a door handle unit, showing replacement bolt, lock washer, and two spacers.

Description—FIG. 4B

FIG. 4B is a back view of vehicle security device 40, after installation on door handle unit 14, showing replacement bolt 43. Each component of security device 40: plate 38, spacers 42, replacement bolt 43, and lock washer 41, is shown in its installed position. Plate 38, with angled horizontal extension 44 and rectangular-shaped extension 49 is aligned behind door handle unit 14. Rectangular-shaped cut out 45 permits plate 38 to surround lock cylinder 10 and actuator 17 on three sides. Plate 38 is shown in place between door handle unit 14 and upper end 23 of linkage rod 18.

Vehicle security device 40 is fastened to door handle unit 14 by placing lock washer 41 on replacement bolt 43 and inserting bolt 43 through plate 38. Factory-installed bolt 32 on bracket 30 is not replaced. Holes 47 for casting flash 21 in plate 38 permit casting flash 21 on door handle unit 14 to be accommodated. Alternative mounting hole 48 is provided in plate 38 to accommodate differences in door handle designs.

Figure 5:
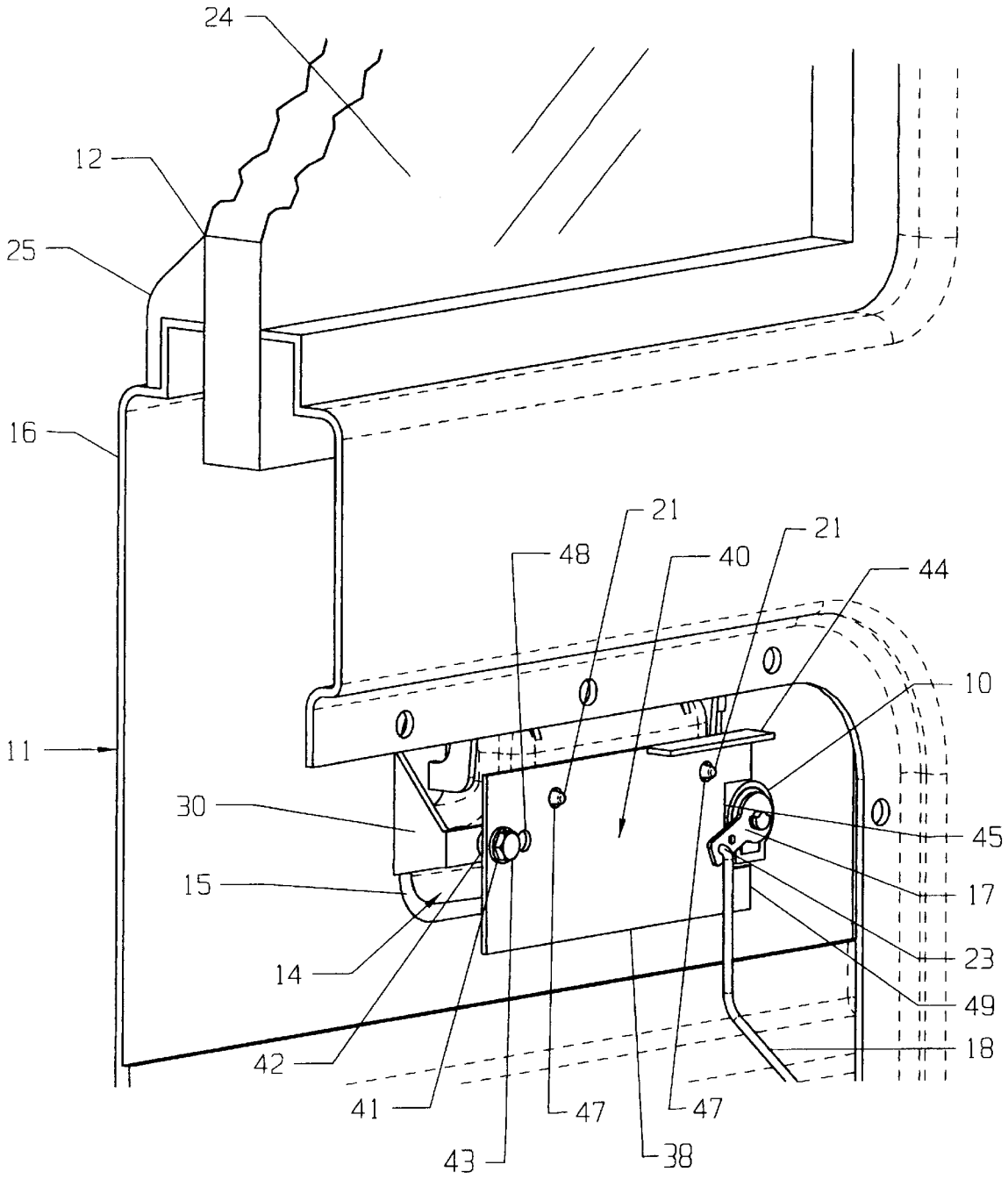
FIG. 5 is an inside view of a portion of a vehicle door showing the vehicle security device after installation on a door handle unit.

Description—FIG. 5

FIG. 5 depicts inside view of a portion of vehicle door 11, showing vehicle security device 40 after installation on a door handle unit 14. Outer shell 16, conforming opening 15 in outer shell 16, base of window 12, and window glass 24 are depicted. Location of flexible molding 25, door handle unit 14, and installed vehicle security device 40 is shown prior to replacement of interior door trim 26, depicted in FIG. 2. Plate 38 is secured into place on door handle unit 14 with replacement bolt 43, lock washer 41, and spacers 42, secured to bracket 30. Actuator 17 located on lock cylinder 10 shows linkage rod 18 connected to actuator 17 at upper end 23 of linkage rod 18. Holes 47 for casting flash 21 permit placement of plate 38 over casting flash 21 on door handle unit 14. Rectangular-shaped cut out 45 creating rectangular-shaped extension 49 at the bottom of plate 38 permits plate 38 to surround lock cylinder 10 on three sides. Angled horizontal extension 44 extends over top of lock cylinder 10 when plate 38 is in place. Alternative mounting hole 48, shown on plate 38, accommodates variations in door handle assemblies.

Figure 6:
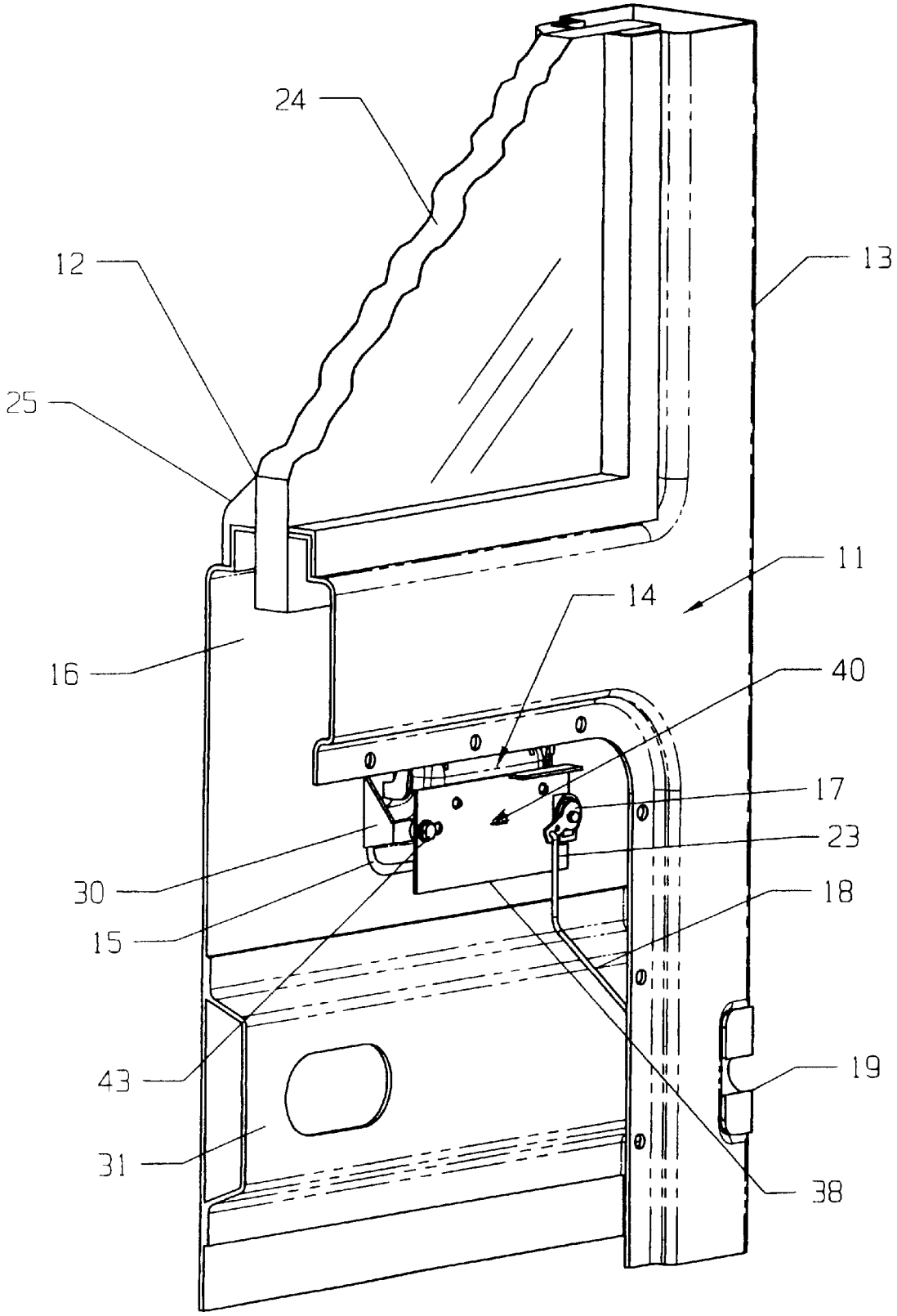
FIG. 6 is an inside view of the vehicle security device, after installation on a door handle unit, showing location of connecting linkage rod to door lock mechanism.

Description—FIG. 6

FIG. 6 is an inside view of vehicle security device 40, after installation on door handle unit 14 in vehicle door 11, showing location of connecting linkage rod 18 to door latch 19. Actuator 17 is in its first position and linkage rod 18 and door latch 19 are in locked position. Replacement bolt 43 secures plate 38 in place through bracket 30. Outer shell 16 of vehicle door 11, conforming opening 15 in outer shell 16, location of window glass 24, flexible molding 25 at base of window 12, linkage rod 18 and its upper end 23 are depicted. Also shown, is side impact beam 31, and back edge of door 13.

Operation and Ramifications

Referring to FIG. 1, lock cylinder 10 and upper end of linkage rod 23 are vulnerable to manipulation by thin tools. Manipulation is either through the space at the base of window 12 between flexible molding 25 and window glass 24, or through forced entry between conforming opening 15 in outer shell 16 and door handle unit 14.

Referring to FIG. 2, without spacers 42, plate 38 would not be in a property secured position to shield, block, and prohibit access to actuator 17.

FIG. 4B depicts location of angled horizontal extension 44 which shields, blocks, and prohibits access to actuator 17 and upper end 23 of linkage rod 18 from above, when a thin tool is inserted. Rectangular-shaped cut out 45 permits plate 38 to surround lock cylinder 10 between inner end of lock cylinder 10 and actuator 17. Rectangular-shaped extension 49 created by cut-out 45 shields, blocks, and prohibits access to upper end 23 of linkage rod 18.

Referring to FIG. 5, access to actuator 17 through flexible molding 25 between base of window 12 and window glass 24 is denied. Slim tools cannot reach actuator 17 and linkage rod 18 with vehicle security device 40 in place, because angled extension 44 blocks such tools. Access to actuator 17 through conforming opening 15 in outer shell 16 of vehicle door 11 and door handle unit 14 is denied, as plate 38 blocks penetration and manipulation by tools. Rectangular-shaped extension 49, located between door handle unit 14 and actuator 17, shields, blocks, and prohibits movement of plate 38 by penetration and manipulation of tools inserted between door handle unit 14 and outer shell 16 through conforming opening 15. Holes 47 for casting flash 21 provide added strength against unauthorized attempts to manipulate plate 38.

Referring to FIG. 6, in the absence of vehicle security device 40 a thief can unlock vehicle door 11 by inserting a thin tool into door 11 between window glass 24 and flexible molding 25 at base of window 12. The thin tool when inserted downward can be used to push actuator 17, or upper end 23 of linkage rod 18, downward, thereby unlocking vehicle door 11. Alternatively, a screw driver or similar tool can be forced into seam between door handle unit 14 and conforming opening 15 in outer shell 16 to accomplish the same result. Vehicle security device 40 defeats such activities.

Alternative Configuration

Vehicle security device shown in the drawings is designed for installation in a passenger-side door. Security device for an opposite door, a driver-side door, has a mirror-image configuration.

Scope of the Invention

The preferred embodiment of the vehicle security device described and shown in the drawings is designed for use in specific types of vehicles, which are light trucks and automobiles of the type manufactured by General Motors Corporation and marketed under various names by General Motors Corporation. The configuration and dimensions of the security device can be modified to accommodate differing interior door mechanisms of other brands of light trucks and automobiles. The device can be equally advantageous in types of vehicles which have doors equipped with both key-operated and electrically-operated door lock cylinders.

The description above contains many specificities, which should not be construed as limiting the scope of the invention, but as merely providing illustrations of some of the presently preferred embodiments of this invention.

Thus the scope of the invention should be determined by the appended claims and their legal equivalents, rather than by the examples given.

What is claimed is:

1. An improved vehicle security device comprising a configured metal plate added to a vehicle door to prohibit unlocking said door by insertion of slim tools or screw drivers through or around said door handle unit or between a window and outer shell of said door to prevent access from outside a vehicle rather than from inside a vehicle, wherein said plate covers an inside portion of said door lock mechanism rather than surrounding or containing said door lock mechanism, the improvements wherein said device can be installed using available tools after a vehicle is manufactured and without disassembly of said door handle unit and connecting rod and without removal of the side impact beam of said vehicle door:

(a) said configured plate disposed within said vehicle door at the location of an inside portion of a door handle unit and secured adjacent to said actuator and connecting rod at a key-turnable inner end of a lock cylinder of said door handle unit, such placement allowing said interior door handle unit to remain uncovered for normal maintenance and repair services;

(b) said configured plate further including a punched hole or holes to accommodate a lock washer or washers, a spacer or spacers, and a replacement bolt or bolts which secure said configured plate to said inside portion of said door handle unit after a vehicle is manufactured;

(c) said configured plate further including punched holes which permit fitting of said plate over a casting flash on certain door handle unit models;

(d) said configured plate further including a rectangular cutout to accommodate said configured plate placement adjacent to said key-turnable inner end of said lock cylinder, without surrounding said lock cylinder through use of a semicircular hole to accommodate said lock cylinder;

(e) said configured plate further including a rectangular-shaped extension on upper side of said configured plate adjacent to said lock cylinder to accommodate placement of said configured plate around said lock cylinder, said configured plate having sufficient tolerance adjacent to said lock cylinder to permit said configured plate to shield, block, and prohibit access to an actuator connected to a linkage on said inner end of said lock cylinder;

(f) said configured plate further including one bend, a horizontal extension, located on the uppermost edge of said plate extending away from outer shell of said vehicle door to prohibit access to an actuator from above by use of a slim tool through opening between a window and window glass, shielding and blocking said actuator and linkage on said inner end of said lock cylinder.

2. The vehicle security device of claim 1 wherein said configured plate has said punched holes to accommodate said replacement bolts which secure said configured plate to said door handle unit.

3. The vehicle security device of claim 1 wherein said configured plate has said horizontal extension at an angle which extends away from said outer shell of said vehicle door.

4. The vehicle security device of claim 1, wherein said configured plate has said punched holes to accommodate protrusions on an inside portion of certain door handle units which differ due to manufacturing methods, and allows installation of said plate flush to backside of said door handle unit and alignment of said vehicle security device with said door handle units.

5. The vehicle security device of claim 1 wherein said configured plate has said rectangular-shaped extension on upper side of said configured plate adjacent to said lock cylinder.

6. The vehicle security device of claim 1 wherein said configured plate has said rectangular-shaped cut out adjacent to said lock cylinder to accommodate said configured plate placement adjacent to said key-turnable inner end of said lock cylinder.

7. A lock mechanism in a vehicle door includes a lock cylinder which is part of a door handle unit disposed at an opening in the outer portion of said door handle unit with an outer end accessible from outside a vehicle and an inner end within said door handle unit which is turnable by use of a door key; and an actuator extending radially from said inner end of said lock cylinder within said door handle unit and a linkage coupling said actuator to said lock mechanism; said lock mechanism protected from illegal entry by the improved vehicle security device, the improvement comprising:

(a) The vehicle security device of the type wherein a configured plate is added to a vehicle door to prohibit unlocking said door by insertion of slim tools or screw drivers through or around said door handle unit or between a window and outer shell of said door, wherein said device covers the inside portion of said door lock mechanism rather than surrounding or containing a door lock mechanism;

(b) The vehicle security device of the type wherein said device can be installed after a vehicle is manufactured without removal of a side impact beam and without disassembly of a lock actuator and connecting rod of said door handle unit using available tools, and which prevents access from outside a vehicle and allows access from inside a vehicle;

(c) The vehicle security device wherein a configured plate prevents unlocking of said vehicle door other than with the key of a vehicle door;

(d) The vehicle security device wherein configured plate has one or more punched holes to accommodate necessary replacement bolts which secure said configured plate to said door handle unit;

(e) The vehicle security device wherein said configured plate has a rectangular-shaped cut out to accommodate plate placement adjacent to key-turnable inner end of said lock cylinder, said configured plate having sufficient tolerance adjacent to said lock cylinder to permit said configured plate to shield, block, and prohibit access to said linkage which is attached to said actuator on said inner end of said lock cylinder;

(f) The vehicle security device wherein said configured plate has punched holes which permit fitting of said configured plate over a casting flash on door handle units of certain models;

(g) The vehicle security device wherein said configured plate has a horizontal extension located on uppermost edge of said configured plate which extends away from an outer shell of said vehicle door, said security device being wholly contained within and concealed by said vehicle door.

8. The configured plate of claim 7 wherein said configured plate has a rectangular-shaped extension located on upper side of said plate adjacent to said lock cylinder.

9. The configured plate of claim 7 wherein said lock cylinder is a component of said door handle unit which is disposed at a conforming opening in said outer shell of said vehicle door and which is secured thereto by a replacement bolt or bolts in said door handle unit, wherein said replacement bolt extends through a bracket to clamp said configured plate against said door handle unit.

10. An improved vehicle door assembly comprising:

(a) a vehicle door;

(b) a locking mechanism located inside a vehicle door;

(c) a door handle unit which operates by using a handle on a door handle unit;

(d) a configured plate disposed within said vehicle door at the location of a key-turnable inner end of a lock cylinder of said vehicle door, wherein said configured plate has a punched hole or holes to accommodate a replacement bolt or bolts which secures said configured plate to said door handle unit;

(e) said configured plate wherein a rectangular-shaped cut out accommodates said configured plate placement adjacent to said key-turnable inner end of said lock cylinder;

(f) said configured plate wherein a rectangular-shaped extension on upper side of said plate adjacent to said lock cylinder accommodates configured plate placement next to said lock cylinder;

(g) said configured plate wherein sufficient tolerance adjacent to said lock cylinder permits said configured plate to shield, block, and prohibit access to an end of linkage which is connected to an actuator on the inner end of said lock cylinder;

(h) said configured plate wherein a punched hole or holes permit fitting of said configured plate over casting flash on door handle units of certain models;

(i) said configured plate wherein a horizontal extension located on uppermost edge of said plate extends away from an outer shell of a vehicle door; and (j) said configured plate installed using available tools after vehicle is manufactured and without disassembly of said door handle unit and connecting rod and without removal of the side impact beam of said vehicle door.

11. The vehicle door assembly of claim 10 wherein said configured plate has said punched hole or holes to accommodate said replacement bolt or bolts which secure said configured plate to said door handle unit.

12. The vehicle door assembly of claim 10 wherein said configured plate has a horizontal extension at an angle which extends away from said outer shell of said vehicle door.

13. The vehicle door assembly of claim 10 wherein said configured plate has said punched hole or holes to accommodate protrusions on an inside portion of certain door handle units which differ due to manufacturing methods, which will align said configured plate with said door handle units.

14. The vehicle door assembly of claim 10 wherein said configured plate has said rectangular-shaped extension on lower side of said configured plate adjacent to said lock cylinder to shield, block, and prohibit access to said key-turnable inner end of said lock cylinder.

15. The vehicle door assembly of claim 10 wherein said configured plate has said rectangular-shaped cut out adjacent to said lock cylinder to accommodate said configured plate placement adjacent to said key-turnable inner end of said lock cylinder.

16. The vehicle door assembly of claim 10 wherein said configured plate can be installed using available tools after a vehicle is manufactured without disassembly of said door handle unit and connecting rod and without removal of the side impact beam of said vehicle door.

* * * * *